US009715981B2

(12) United States Patent
Becker et al.

(10) Patent No.: US 9,715,981 B2
(45) Date of Patent: Jul. 25, 2017

(54) SYSTEM CABLING FOR A MULTIPLE RELAY ARRANGEMENT

(75) Inventors: Markus Becker, Paderborn (DE); Heinrich Heise, Horn-Bad Meinberg (DE); Christoph Leifer, Bad Driburg (DE); Andreas Woehrmeier, Doerentrup (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 920 days.

(21) Appl. No.: 14/117,066

(22) PCT Filed: May 15, 2012

(86) PCT No.: PCT/EP2012/002075

§ 371 (c)(1),
(2), (4) Date: Jul. 3, 2014

(87) PCT Pub. No.: WO2012/156075

PCT Pub. Date: Nov. 22, 2012

(65) Prior Publication Data

US 2015/0187523 A1 Jul. 2, 2015

(30) Foreign Application Priority Data

May 16, 2011 (DE) ..... 10 2011 101 686

(51) Int. Cl.

| | |
|---|---|
| ***H01H 45/14*** | (2006.01) |
| ***H01H 50/04*** | (2006.01) |
| ***H01R 9/26*** | (2006.01) |
| ***H01B 7/08*** | (2006.01) |

(52) U.S. Cl.

CPC ..... *H01H 45/14* (2013.01); *H01B 7/08* (2013.01); *H01H 50/048* (2013.01); *H01R 9/2633* (2013.01); *H01R 9/2675* (2013.01); *H01H 2207/022* (2013.01); *Y10T 307/747* (2015.04)

(58) Field of Classification Search

CPC .. H01H 2207/022; Y10T 307/747; H01B 7/08
USPC ..... 307/156
See application file for complete search history.

(56) References Cited

U.S. PATENT DOCUMENTS

2004/0087215 A1 5/2004 Pohl et al.

FOREIGN PATENT DOCUMENTS

| | | | |
|---|---|---|---|
| DE | 3923137 | C1 | 11/1990 |
| DE | 4233722 | A1 | 4/1994 |
| DE | 29610415 | U1 | 8/1996 |
| EP | 1760745 | A1 | 3/2007 |
| JP | 5260792 | A | 5/1977 |
| JP | 54125494 | A | 9/1979 |

(Continued)

OTHER PUBLICATIONS

German Office Action, German Patent and Trademark Office,Mar. 12, 2012, DE 10 2011 101 686.8.

(Continued)

*Primary Examiner* — Robert Deberadinis
(74) *Attorney, Agent, or Firm* — Leydig, Voit & Mayer, Ltd.

(57) ABSTRACT

A multiple relay arrangement having a plurality of relay sockets which are arranged next to each other and a plurality of relays. The relay sockets contain additional plug connections with which the relays are controlled by the system cabling. The system cabling contains a distribution section having cable sections and plug connectors and allows the plurality of relays to be controlled.

18 Claims, 4 Drawing Sheets

(56) References Cited

FOREIGN PATENT DOCUMENTS

| | | | |
|---|---|---|---|
| JP | 5578433 | A | 6/1980 |
| JP | 6388770 | A | 4/1988 |
| JP | 340621 | A | 2/1991 |
| JP | 7226269 | A | 8/1995 |
| WO | WO 2008064618 | A1 | 6/2008 |
| WO | WO 2012000808 | A1 | 1/2012 |

OTHER PUBLICATIONS

"Dr. Haselberg Datentechnik, Elektronik für Industrie und Freizeit", Dr, Haselberg Datentechnik, Westfahlenring 5, 45739 Oer-Erkenschwick, Tel.: 02368-80868, 2005, http://www.hard.de/bilder%20sps.htm, http://www.hard.de/technische%20daten.htm, http://www.hard.de/impressum.htm.

Relaissockel Serie 788, Produktinformation der Firma WAGO, Innovative Connections, Kontakttechnik GmbH & Co. kG, 32423 Minden, Hansastr. 27, Jahrgang Dec. 2005, http://www.wagocatalog.com/okv3/Download_files/WAGO_BZ_Serie_788.pdf.

Written Opinion of ISA, PCT/EP2012/002075 (Nov. 28, 2013).

Japanese Office Action, Japanese Patent Office, Jan. 27, 2015, Dispatch No. 032730.

SYSTEM CABLING FOR A MULTIPLE RELAY ARRANGEMENT

CROSS-REFERENCE TO RELATED APPLICATIONS

This application is a U.S. National Phase application under 35 U.S.C. §371 of International Application No. PCT/EP2012/002075, filed on May 15, 2012, and claims benefit to German Patent Application No. DE 10 2011 101 686.8, filed on May 16, 2011. The International Application was published in German on Nov. 22, 2012, as WO 2012/156075 A2 under PCT Article 21(2).

FIELD

The invention relates to a multiple relay arrangement with a plurality of relay sockets, which are arranged next to each other, and which can have varying dimensions, in order to also accommodate different relays. Each relay socket has a relay plug connector, input and output connections and an at least bipolar additional plug connector for additional electronics, and can be plugged onto a mounting rail.

BACKGROUND

A plug-in mounting with two-part connection part having respective contact reeds to fix connecting cables or wires in the plug-in mounting using a plug part and screw fixings is known from DE 39 23 137 C1. Such plug-in mountings can be fixed next to each other on a rail and bridging brackets between the plug-in mountings ensure neutral conductor connections (DE 42 33 722 A1).

Modules arranged in a row on a rail can be combined into module groups using 8-pole pin contacts (Dr. Hasberg Datentechnik, Elektronik fuer Industrie und Freizeit). The connection (system bus) between the module groups can be achieved with Cat. 5e patch cables with shielded connectors.

Relay sockets with additional bipolar plug connectors are known (EP 1 760 745 A2, relay socket series 788; company: WAGO) and serve to connect a visual display, for example.

Such relay sockets are normally arranged in rows in groups on a mounting rail and must be connected to control devices, distributor modules and similar. For this purpose, cable harnesses with individual wiring for the respective application case are used in practice. Also known in practice, however, are prefabricated cables with a group connector for a group of relay sockets arranged next to each other, which constitutes a type of system cabling. A disadvantage of this connecting system is the need to use relay sockets of equal width next to each other so that the connection with the group connector fits.

An aspect of the invention creates system cabling for relay sockets which are arranged next to each other, in which the relay sockets can have varying dimensions in the longitudinal direction of the rail.

SUMMARY

An aspect of the invention provides a multiple relay arrangement, comprising: (a) a plurality of relay sockets, which relay sockets (a-1) are arranged next to each other, (a-2) are plugged onto a mounting rail, (a-3) are configured to be able to have varying dimensions in a longitudinal direction of the mounting rail, (a-4) each include an input plug connector configured for input of the respective relay, an output plug connector configured for output of the respective relay, a control input connection configured for the respective relay, an output connection configured for the respective relay, and (a-5) an at least bipolar additional plug connection configured for additional electronics, which additional plug connection is located parallel to the control input connection and is connected to the input plug connector to the respective relay; (b) a plurality of the relays, which are plugged as a group next to each other into the associated input plug connectors and output plug connectors; and (c) system cabling configured to control the group of relays, which system cabling includes a plurality of cable sections and plug connectors, wherein the plug connectors are plugged into the additional plug connections of the relay sockets and the cable sections, wherein the cable sections bridge gaps between the additional connections.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

The invention takes advantage of standard relay sockets being equipped with an additional plug connector for additional electronics, which have access to the control input of the respective relay. The new type of system cabling is equipped with a plurality of plug connectors, which are each designed to connect to an additional plug connection of a respective relay socket in order to thus connect the relays to a control device or distributor module or similar. Between the plug connectors there are cable sections, which facilitate the bridging of different centre-to-centre distances of relay sockets. In this way the system cabling can be connected to a group of relay sockets, which are arranged next to each other, without the relay sockets having to have the same dimensions in the longitudinal direction of the rail The system cabling can take the form of a cable harness with plug connectors included therein, which are connected to a multiple-pole connector via pairs of conductors of the cable.

A star-shaped arrangement of the pairs of conductors can be implemented between the multiple-pole connector and the individual plug connectors. It is, however, also possible to implement a serial arrangement of the pairs of conductors between the multiple-pole connector and the respective plug connectors.

It is particularly advantageous for the cable harness to use a pre-configured flat ribbon cable, which contains a conductor crossover point with conductor lead-outs for each connector. The cable sections of the system cabling correspond to the distance of the conductor crossover points from each other.

The additional electronics of a known type are accommodated inside a respective housing, which has a connector to interact with the additional plug connection of the relay socket. Such a housing with the additional electronics accommodated therein is integrated in the system cabling with the plug connector thereof. The additional electronics, which are known per se, comprise a suppressor circuit and/or status indicator for the relay, as required. The additional electronics can also constitute a free-wheeling diode, an RC combination or a varistor, for example.

Figure 1:
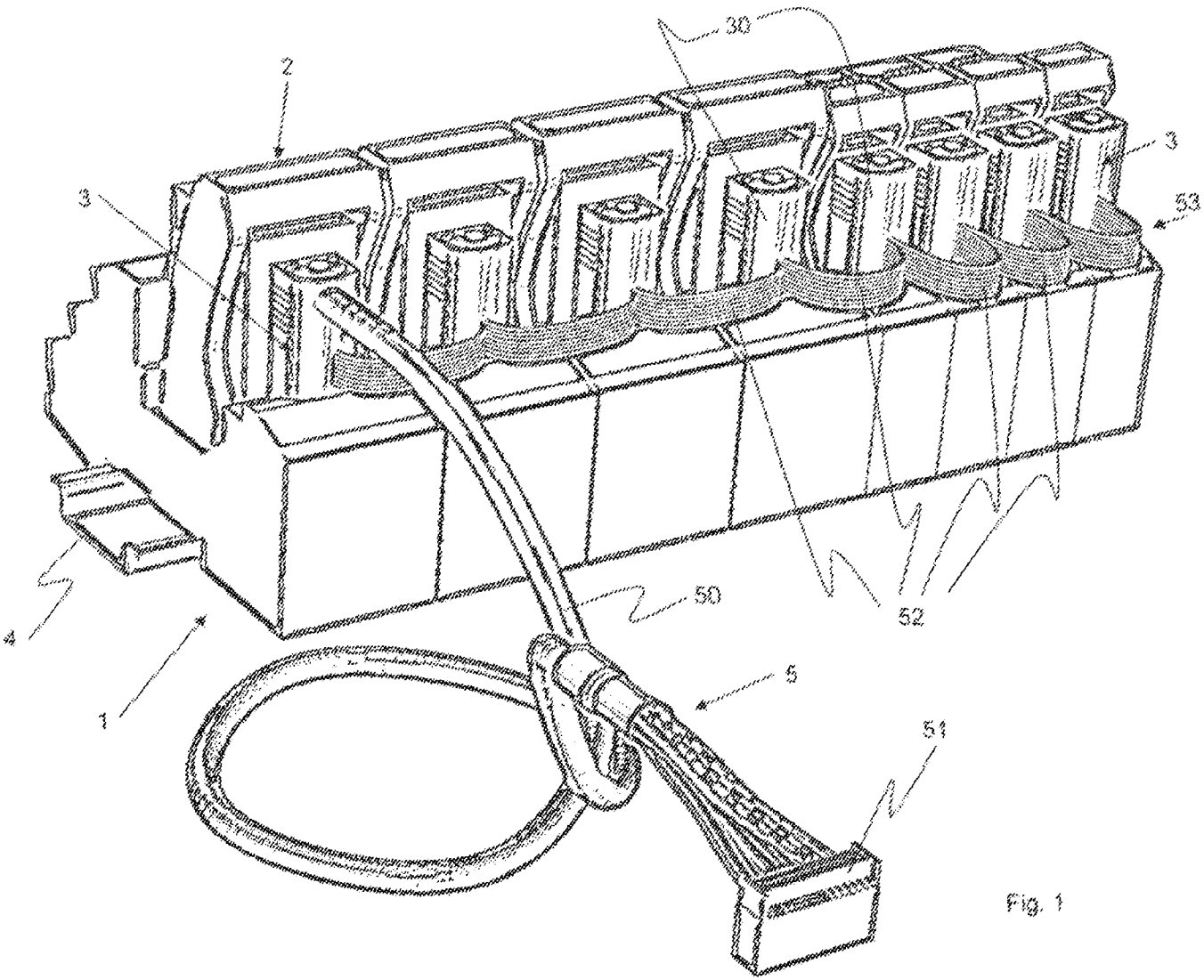
FIG. 1 shows a multiple relay arrangement with a cable harness in perspective view.

FIG. 1 shows a multiple relay arrangement with eight units, which each comprise a relay socket 1, a relay 2 and additional electronics 3. The relay sockets 1 are plugged next to each other on a mounting rail 4 and are fixed in that position. The units comprising relay socket, relay and additional electronics constitute a group, which is controlled via system cabling in the form of a cable harness 5.

Figure 2:
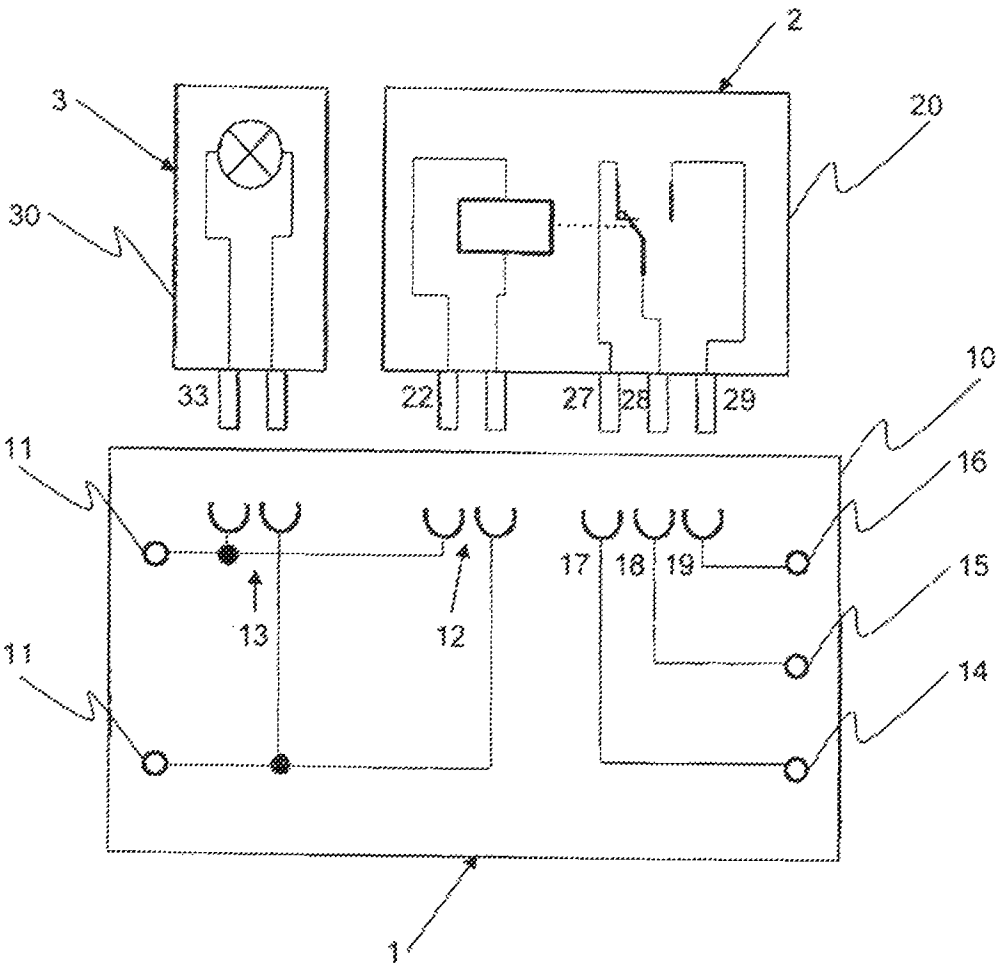
FIG. 2 shows a schematic view of a relay socket, a relay and additional electronics.

The schematic view of FIG. 2 shows the connections inside the relay socket 1, the relay 2 and the additional electronics 3. The relay socket, relay and additional electronics are accommodated inside the housings 10, 20 and 30 respectively, the design and dimensions of which are standardised. The relay socket 1 comprises input connections 11, which are connected to the relay 2 via wires with a connector 12 and to the additional electronics 3 with a connector 13. The relay socket 1 comprises three output connections 14, 15, 16, which are connected via wires with connectors 17, 18, 19, which lead to the output circuit of the relay 2. The input and output circuits of the relay 2 comprise mating plugs 22, 27, 28, 29 to form a plug connection with the corresponding connectors 12, 17, 18 and 19 of the relay socket 1. The internal construction of the relay 2, shown electromechanically here, can also be electronic, as known. The additional electronics 3 have a plug connector 33 to interact with the connector 13 of the relay socket 1.

The cable harness 5 comprises a supply cable 50, a multiple-pole connector 51 and a series of cable sections 52, which form a distributor section 53. The cable sections 52 are fed in curves, which extend between the individual housings 30 of the additional electronics 3 and connect them. In the case of the wider relay sockets 1 the curves of the cable sections 52 are wider and in the case of the narrower relay sockets 1 the curves are tighter. By selecting the length of the cable sections 52 accordingly, it can be ensured that any type of relay socket, whether wide or narrow, can be covered by one and the same system cabling.

Figure 3:
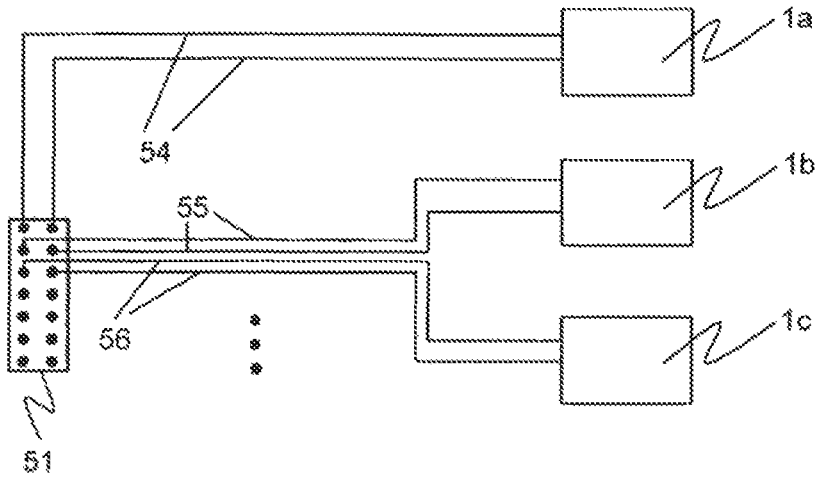
FIG. 3 shows a star-shaped arrangement of pairs of conductors of a cable harness.

FIG. 3 shows a star-shaped arrangement of the system cabling. Pairs of conductors 54, 55, 56 are shown, which lead from a multiple-pole connector 51 to the relay sockets 1*a*, 1*b*, 1*c*. The length of the pairs of conductors varies according to the length of the cable sections 52, which is not shown in FIG. 3.

Figure 4:
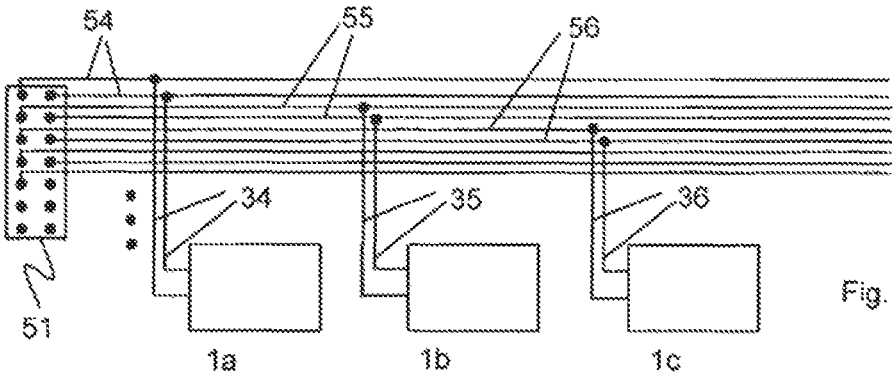
FIG. 4 shows a serial arrangement of pairs of conductors of the cable harness.

FIG. 4 shows a serial arrangement of the system cabling. The pairs of conductors 54, 55, 56 are continuous but are tapped at the intervals of the cable sections 52, the branches 34, 35, 36 being located inside the respective housing 30 of the additional electronics 3 and leading to the respective connectors 33.

Figure 5:
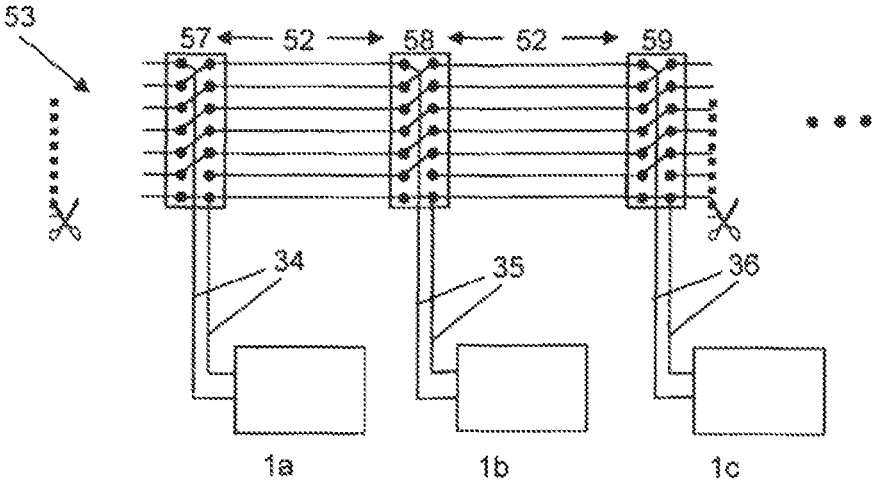
FIG. 5 shows a pre-configured cable for use in the serial arrangement of the cable harness.

FIG. 5 shows the use of a pre-configured flat ribbon cable to produce the distribution section 53. There are conductor crossover points 57, 58, 59, from which the branches 34, 35, 36 lead to the plug connectors 13/33 and thus to the relay sockets 1*a*, 1*b*, 1*c*. The distance between the conductor crossover points 57, 58, 59 corresponds to the length of each cable section 52. The conductor crossover points 57, 58, 59 are each accommodated in a housing 30 of the additional electronics, while the cable sections 52 extend outside this housing 30, as shown in FIG. 1.

Figure 6:
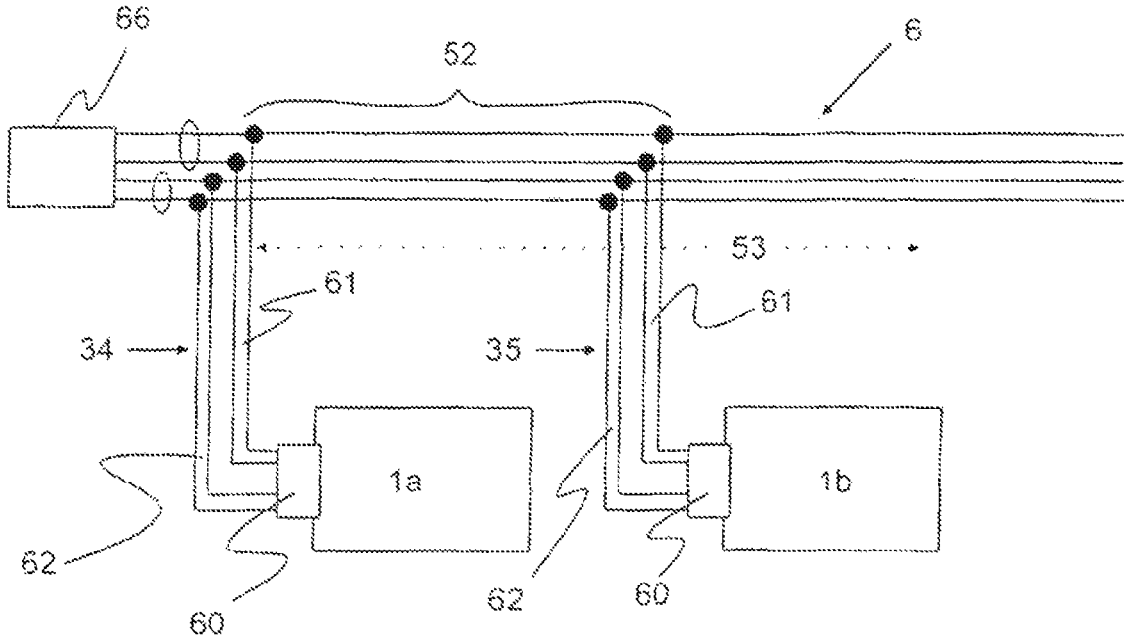
FIG. 6 shows a multiple relay arrangement, which can be controlled via bus signals.

The system cabling can be used in bus systems 6, which work with digital signals (FIG. 6). The bus system 6 comprises a gateway 66 on the input side and contains a distribution section 53 with cable sections 52 between which the branches 34, 35 lead to connection modules 60.

The branches 34, 35 comprise signal wires 61 and power supply wires 62, which lead to the respective plug connector 33 of the relay socket 19, 16.

Figure 7:
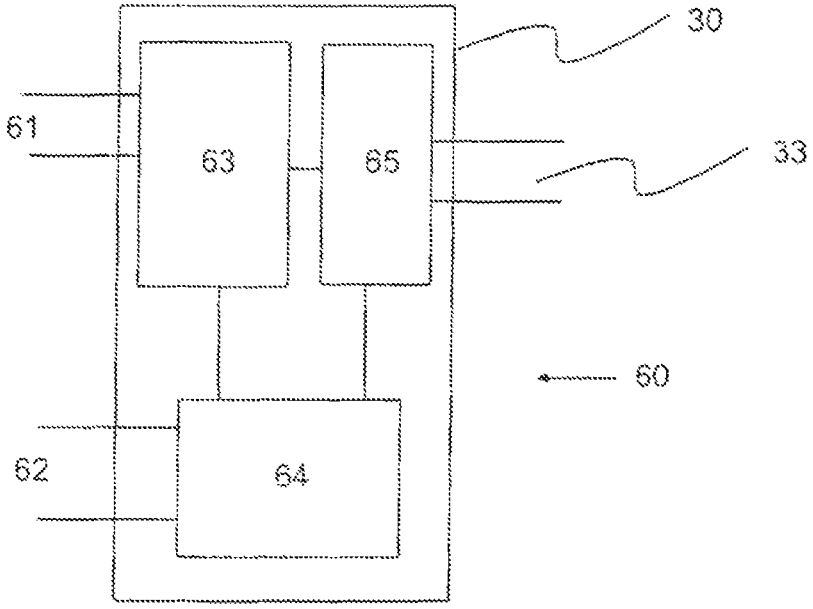
FIG. 7 shows the schematic arrangement of a connection module for the multiple relay arrangement according to FIG. 6.

FIG. 7 schematically shows the arrangement of a connection module 60, which is accommodated in a housing 30. A signal processing device 63, a power conditioning device 64, and a driver stage 65 for controlling the associated relay 2 are provided. The plug connectors 33 lead to the relay socket 1 and the associated relay 2, as in the case of FIG. 2.

The invention thus provides system cabling in which the relay 2 can be controlled via the connections 33, which can otherwise be used for additional electronics 3. A type of cable harness 5 is used, which has a connection section 50 and a distribution section 53 with a series of cable sections 52 of a certain length, which make it possible to operate groups of relay sockets 1, which can also be of varying widths.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A multiple relay arrangement, comprising:

(a) a plurality of relay sockets, which relay sockets (a-1) are arranged next to each other, (a-2) are plugged onto a mounting rail, (a-3) are configured to be able to have varying dimensions in a longitudinal direction of the mounting rail, (a-4) each include an input plug connector configured for input of a respective relay, an output plug connector configured for output of the respective relay, a control input connection configured for the respective relay, an output connection configured for the respective relay, and (a-5) an at least bipolar additional plug connection configured for additional electronics, which additional plug connection is located parallel to the control input connection and is connected to the input plug connector to the respective relay;

(b) a plurality of the relays, which are plugged as a group next to each other into the associated input plug connectors and output plug connectors; and (c) system cabling configured to control the relays, which system cabling includes a plurality of cable sections and plug connectors, wherein the plug connectors are plugged into the additional plug connections of the relay sockets and the cable sections, wherein the cable sections bridge gaps between the additional connections.

2. The multiple relay arrangement of claim 1, wherein the system cabling further includes a cable harness, a supply cable, and a distribution section, wherein the distribution section is configured to supply the relay groups, and wherein the system cabling is constructed of pairs of conductors and plug connectors included therein.

3. The multiple relay arrangement of claim 2, wherein the pairs of conductors are connected via branches to the respective plug connectors.

4. The multiple relay arrangement of claim 3, wherein the branches are accommodated inside housings of the additional electronics.

5. The multiple relay arrangement of claim 2, wherein a star-shaped arrangement of the pairs of conductors is implemented between a multiple-pole connector and the individual plug connectors.

6. The multiple relay arrangement of claim 2, wherein a serial arrangement of the pairs of conductors is implemented between a multiple-pole connector and the individual plug connectors.

7. The multiple relay arrangement of claim 6, wherein the cable harness includes a pre-configured flat ribbon cable as a distribution section, wherein the flat ribbon cable includes a conductor crossover point with a conductor lead-through for each plug connector used.

8. The multiple relay arrangement of claim 1, wherein at least one of the plug connectors is connected to a housing and the additional electronics accommodated in the housing.

9. The multiple relay arrangement of claim 1, wherein the additional electronics include a suppressor circuit.

10. The multiple relay arrangement of claim 1, wherein the additional electronics include a free-wheeling diode.

11. The multiple relay arrangement of claim 1, wherein the additional electronics include an RC combination.

12. The multiple relay arrangement of claim 1, wherein the additional electronics include a timer circuit.

13. The multiple relay arrangement of claim 1, wherein the system cabling includes a bus system including a distribution section configured to supply the relay group, wherein the distribution section is divided into cable sections from which branches lead to the connection modules to which the relay sockets and relays are assigned.

14. The multiple relay arrangement of claim 1, wherein the additional electronics include a status indicator of the relay.

15. The multiple relay arrangement of claim 9, wherein the additional electronics include a status indicator of the relay.

16. The multiple relay arrangement of claim 9, wherein the additional electronics include a free-wheeling diode.

17. The multiple relay arrangement of claim 9, wherein the additional electronics include an RC combination.

18. The multiple relay arrangement of claim 9, wherein the additional electronics include a timer circuit.

* * * * *